United States Patent [19]

McKinney

[11] 4,401,270

[45] Aug. 30, 1983

[54] SPRAYER FOR SQUEEZE BOTTLE

[76] Inventor: James C. McKinney, 555 Kings Peak, Alpharetta, Ga. 30201

[21] Appl. No.: 292,951

[22] Filed: Aug. 14, 1981

[51] Int. Cl.[3] ..... B65D 1/32

[52] U.S. Cl. ..... 239/327; 222/212; 222/215

[58] Field of Search ..... 239/327; 222/211, 215, 222/212

[56] References Cited

U.S. PATENT DOCUMENTS

| | | | |
|---|---|---|---|
| 2,924,393 | 2/1960 | Robert | 239/327 |
| 3,170,633 | 2/1965 | Castelli | 239/327 |
| 4,020,979 | 5/1977 | Shay et al. | 222/211 |

FOREIGN PATENT DOCUMENTS

| | | | |
|---|---|---|---|
| 634610 | 3/1950 | United Kingdom | 239/327 |

*Primary Examiner*—Andres Kashnikow

*Attorney, Agent, or Firm*—James B. Middleton

[57] ABSTRACT

A sprayer for a squeeze type bottle, the sprayer having spray, stream, and off conditions. A body is used as a closure for the bottle, and passages are defined within the body. The air passage is close to a mixing chamber, and the liquid must pass through a dip tube, through feed tubes, then into the side of a stream of air so the liquid is broken up by the turbulence. After mixing, the spray passes through an orifice in a ring. The ring may be shifted to block the mixing chamber and cause the orifice to be aligned with a liquid passageway to provide a steady stream of liquid from the container, or the ring may be shifted to block all passages to place the sprayer in an off condition.

7 Claims, 10 Drawing Figures

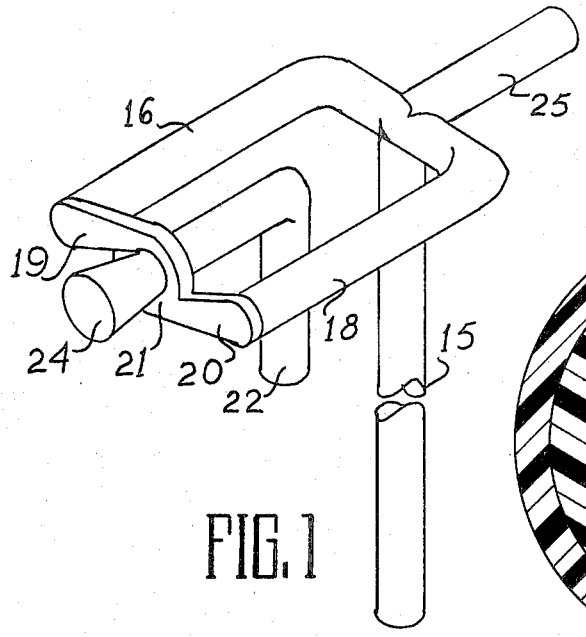
FIG. 1
FIG. 2
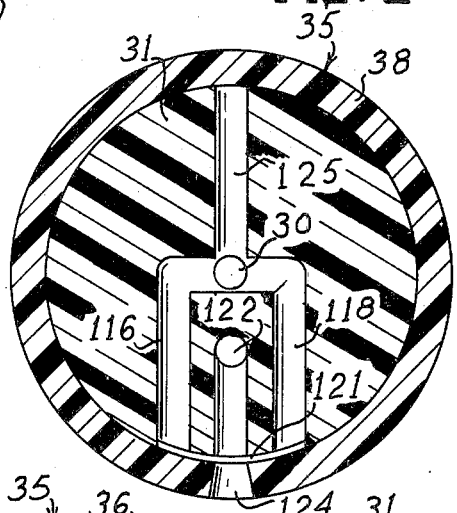
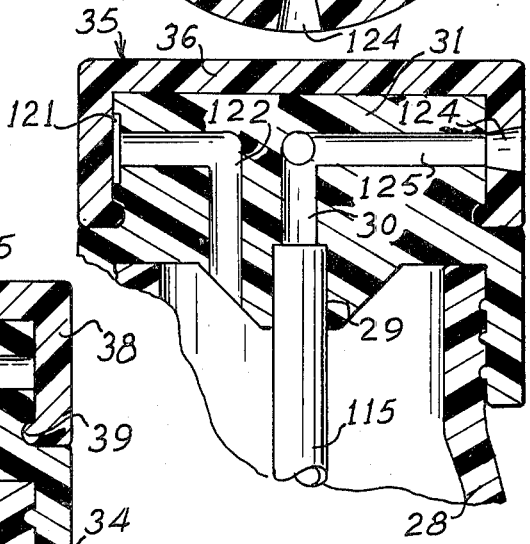
FIG. 4
FIG. 3
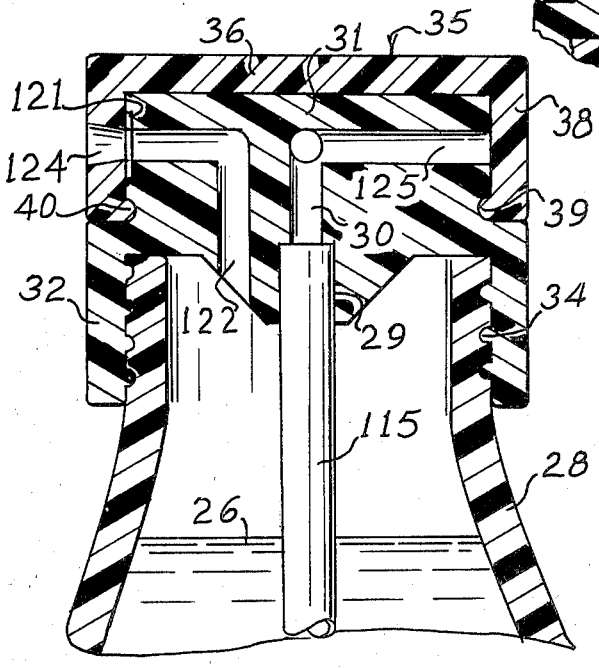

FIG. 5
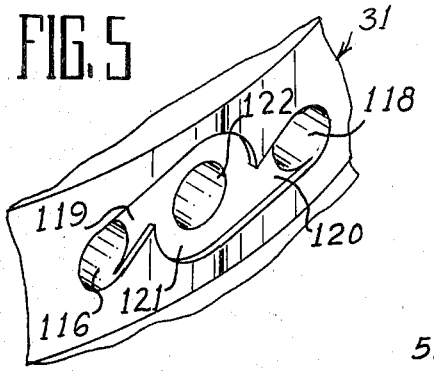
FIG. 8
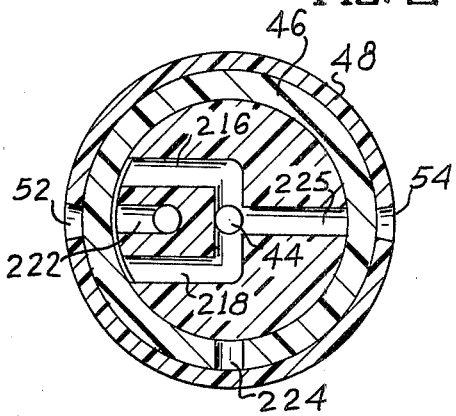
FIG. 6
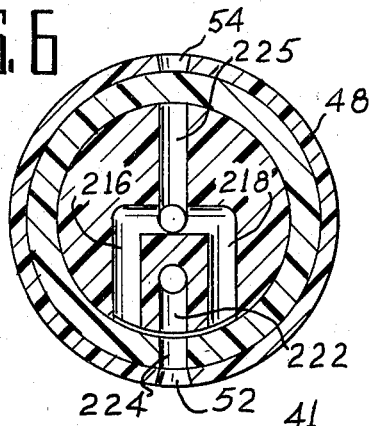
FIG. 9
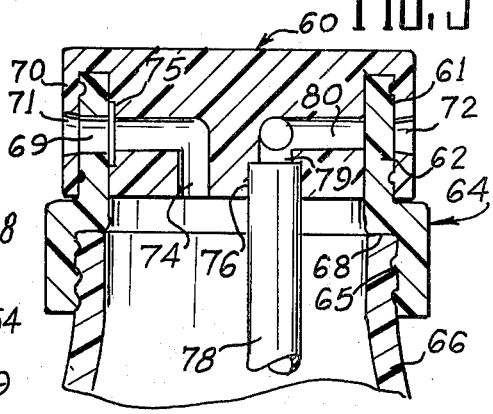
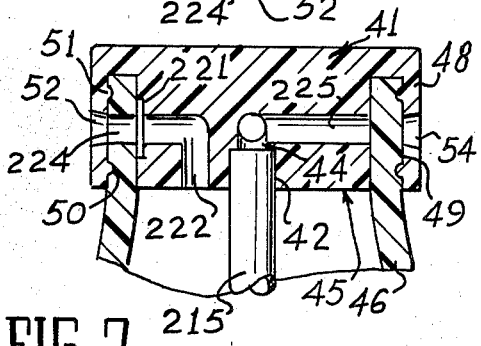
FIG. 7
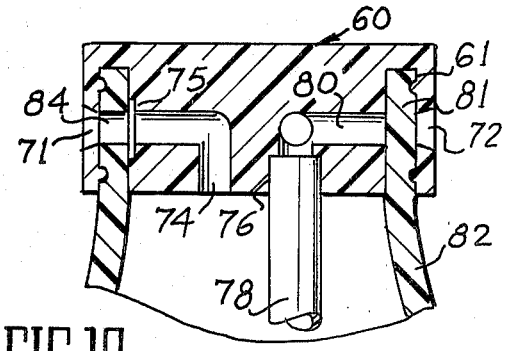
FIG. 10

SPRAYER FOR SQUEEZE BOTTLE

FIELD OF THE INVENTION

This invention relates generally to spraying apparatus, and is more particularly concerned with a sprayer for a squeeze bottle, the sprayer having a highly efficient atomizing arrangement.

BACKGROUND OF THE INVENTION

While squeeze bottle type sprayers have been used for many years, such sprayers were largely displaced for a period of time by spraying apparatus using a pressurized can. More recently, due to the very high cost of a product purchased in a pressurized can, in addition to the possible harm to the atmosphere by fluorocarbons used as the propelling gas, squeeze bottle type sprayers and manual pump sprayers are becoming quite prevalent.

The products dispensed in the form of a spray range extremely widely from products as easily atomizable as water, and as difficult to atomize as a reasonably heavy petroleum or a vegetable oil. If a product is to be sprayed from a pressurized can, there is sufficient force available that mechanical means can be used to break up the liquid droplets to produce a relatively fine spray; however, when the force is to be supplied manually, either by squeezing a bottle or using a pump or a trigger spray or the like, it is much more difficult to achieve a very high degree of atomization for products such as petroleum or vegetable oil.

For many years, squeeze bottle type sprayers have utilized a dip tube extending into the liquid and connected to a passage that leads directly to the spray orifice. Air is conveyed through another passage and caused to impinge on the stream of liquid in an effort to break up the liquid into droplets, and to disperse the liquid into the desired spray pattern. When the liquid has not been sufficiently atomized, or sufficiently dispersed, efforts have been made to cause additional swirling of the air and liquid at the point of mixture, but the basic technique has remained about the same.

SUMMARY OF THE INVENTION

The present invention overcomes the above mentioned and other difficulties with the prior art squeeze bottle type sprayers by providing means to establish a flow of air through an orifice, and means to add liquid to the flow of air, the liquid being added in a somewhat tangential direction. Since the flow of air is first established, the very first liquid that emerges from the spray orifice is finely divided and intimately mixed with air. When the squeeze bottle is released to stop the spraying, air is drawn back into the bottle through the air passage, and this action immediately retrieves any liquid drops so that shut-off is immediate with no dripping. The present invention further includes means for rotating the passages with respect to the orifice so that the spraying device has an "off" position; and, an additional liquid passage may be provided selectively alignable with the orifice to provide a liquid stream. Thus, a spraying device made in accordance with the present invention may have a spraying position, a stream position, and an "off" position.

BRIEF DESCRIPTION OF THE DRAWINGS

These and other features and advantages of the present invention will become apparent from consideration of the following specification when taken in conjunction with the accompanying drawings in which:

FIG. 1 is a schematic illustration showing the passages to be provided in a sprayer made in accordance with the present invention to illustrate the operation of the invention;

FIG. 2 is a horizontal cross-sectional view taken through the orifice of one form of sprayer made in accordance with the present invention;

FIG. 3 is a diametrical cross-sectional view taken through the orifice of the device shown in FIG. 2;

FIG. 4 is a view similar to FIG. 3 but showing the sprayer in the stream position;

FIG. 5 is a much-enlarged perspective view showing the mixing chamber of a sprayer such as that shown in FIGS. 2–4; FIG. 6 is a view similar to FIG. 2, but showing a modified form of sprayer made in accordance with the present invention;

FIG. 7 is a view similar to FIG. 3, but showing the embodiment of the invention shown in FIG. 6;

FIG. 8 is a view similar to FIG. 6, but showing the sprayer in the "off" position;

FIG. 9 is a view similar to FIGS. 4 and 7, but showing another modified form of sprayer made in accordance with the present invention; and, FIG. 10 is a view similar to FIG. 9 showing yet another modification of the present invention.

DESCRIPTION OF THE PREFERRED EMBODIMENTS

Referring now more particularly to the drawings, and to those embodiments of the invention here chosen by way of illustration, it will be seen in FIG. 1 of the drawings that the sprayer arrangement of the present invention includes a dip tube 15 connected to a pair of liquid feed tubes 16 and 18. The liquid feed tubes 16 and 18 communicate with transverse passageways 19 and 20 which direct liquid into the mixing chamber 21.

There is an air passage 22 which passes through the center of the mixing chamber 21, and communicates with the spray orifice 24.

With this arrangement, it will be understood that air will pass through the air passage 22 and through the mixing chamber 21 and out through the orifice 24. After a flow of air has been established, liquid will pass through the dip tube 15 and into the liquid feed tubes 16 and 18. From the feed tubes, the liquid will be directed through the passages 19 and 20 into the mixing chamber 21. With the fluid flow arrangement, it will be understood that a liquid will be swirled around the mixing chamber 21 while the air flows generally axially therethrough. The result is that the liquid will be subjected to considerable turbulence and will be intimately mixed with the air and carried with the air through the orifice 24.

It will also be seen in FIG. 1 of the drawings that there is an additional liquid passageway 25 which, as here shown, extends in the opposite direction from the air passageway 22. It should be understood that the orifice 24 is relatively stationary while the rest of the apparatus shown in FIG. 1 would be rotatable. As a result, the assembly can be rotated to cause the passageway 25 to be aligned with the orifice 24. In this position, it will be understood that liquid will pass through the dip tube 15 and through the passageway 25 and through the orifice 24. There is no air to be mixed with the liquid so the result will be a stream of liquid.

Also, it will be understood that the assembly can be rotated so that none of the passageways is aligned with the orifice 24, so no fluid would pass through the orifice 24.

With the foregoing general discussion in mind, attention is next directed to FIGS. 2, 3, and 4 of the drawings, which show one embodiment of the invention.

Looking at FIG. 3, it will be seen that there is a dip tube 115 which is immersed in a liquid indicated at 26 within a bottle 28. The bottle 28 is fragmentarily represented, but those skilled in the art will understand that any conventional squeeze type bottle will operate satisfactorily with the sprayer of the present invention. Such bottles are well known in the art, and no further details are thought to be necessary.

The dip tube 115 is contained within a recess 29 which communicates with a passageway 30. The passageway 30 extends vertically to communicate with the pair of liquid feed tubes 116 and 118 (FIG. 2), in addition to the liquid passageway 125.

The liquid feed tubes 116 and 118 extend generally parallel to the air passage 122, and all three of these tubes communicate with the mixing chamber 121.

Looking primarily at FIG. 3 of the drawings, it will be seen that the above described passageways are formed within a body 31, the body 31 having an annular skirt 32 depending therefrom, the skirt 32 having interior threads 34. The bottle 28 has mating threads so that the skirt 32 constitutes a screw cap for the bottle 28, and the body 31 constitutes a closure for the bottle 28.

Covering the body 31, there is here shown a rotatable cap 35. The cap 35 has a generally flat upper web 36 with a ring 38 attached thereto. As here shown, the lower edge of the ring 38 is provided with a bead 39 receivable within a recess 40 in the body 31. Those skilled in the art will devise numerous other forms of connection, but the simple bead and groove 39 and 40 here shown would allow the cap 35 to be rotatable while holding the cap in place on the body 31.

It will now be seen that the orifice 124 is defined in the ring 38 of the cap 35. Thus, when the cap 35 is in the position shown in FIG. 3, or FIG. 2, of the drawings, the bottle 28 can be squeezed and air will be forced from within the bottle, above the liquid 26, through the air passage 22, through the mixing chamber 121 and through the orifice 124. After the air flow is established, liquid will be forced through the dip tube 115 and through the passage 30, then to the liquid feed tubes 116 and 118, into the mixing chamber 121 and out through the orifice 124.

Looking briefly at FIG. 4 of the drawings, it will be seen that the cap 35 with the ring 38 has been rotated 180° so that the liquid passage 125 is aligned with the orifice 124. It will also be seen that the air passage 122 and the liquid feed tubes 116 and 118 are covered by a solid portion of the ring 38. As a result, when the bottle 28 is squeezed, the air passage 122 is blocked and the only fluid flow that can take place is the flow of liquid through the dip tube 115, through the passage 30 and through the liquid passage 125, thence through the orifice 124. This will result in the dispensing of a steady stream of liquid with no air mixed therein.

It should now be understood, with reference to FIG. 2 of the drawings, that the cap 35 can be rotated so that none of the passages is aligned with the orifice 124 in the ring 38, and the sprayer will be in an "off" position.

It will also be understood by those skilled in the art that, while FIGS. 2, 3 and 4 illustrate the spray position and the stream position as being located 180° from each other, these two conditions could be provided at other angles of rotation, or at locations requiring other motions of the ring 38. For example, the ring 38 could move vertically for a "push-pull" arrangement, or some combination of motions could be used. So long as the passages 116, 118 and 122 are moved away from the orifice 124, and the passage 125 is moved into alignment with the orifice 124, the sprayer will change from a spray condition to a stream condition. Further, when all of the passages are not aligned with the orifice 124, the sprayer will be in an "off" condition. The particular orientation for the various passages will be dictated by the demands of manufacture, and any orientation will operate satisfactorily. Also, those skilled in the art will understand that visual indicia, or physical stops, would be included to allow selection.

Looking now at FIG. 5 of the drawings, it should be understood that mixing chambers for use in sprayers of the type herein disclosed are well known in the art, and the particular mixing chamber appears not to be critical in the sprayer of the present invention. Nevertheless, FIG. 5 of the drawings shows one form of mixing chamber that works quite well with the sprayers made in accordance with the present invention. As shown in FIG. 5, the cap 35 has been removed, and the body 31 is shown as defining a cavity therein constituting the mixing chamber 121. It will therefore be seen that the liquid feed tubes 116 and 118 terminate at the edge of the body 31, and communicate with the passages 119 and 120. These passages communicate with the mixing chamber proper 121 which is formed as a spotface on the side of the body 31 with the air passage 122 centrally of the spotface.

It will therefore be seen that liquid will pass through the liquid feed tubes 116 and 118 and will be stopped by the ring 38. The only direction for the liquid is then to pass through the passageways 119 and 120 to be directed sideways, somewhat tangentially, into the mixing chamber 122. With the air flow established through the air passageway 122 from front to rear, it will be understood that the liquid will tend to become entrained in the stream of air, but will take a helical pattern due to its angular momentum, so there is considerable agitation to cause the liquid to break into fine droplets and become intimately mixed with the air.

It will be noticed that the embodiment of the invention disclosed in FIGS. 2, 3, and 4 can conveniently be made in three pieces: the body 31 with its annular skirt 32, the cap 35, and the dip tube 115. Looking at FIGS. 6, 7, and 8 of the drawings, it will be seen that approximately the same device can be made in only two pieces.

The device shown in FIG. 7 of the drawings includes a body 41 having a recess 42 for receiving the dip tube 215. The recess 42 communicates with the liquid passageway 44, and the liquid passageway 44 communicates with the liquid passage 225, and with the liquid feed tubes 216 and 218 shown in FIG. 6.

The air passageway 222 extends from the lower surface of the body 41, then bends to the side of the body 41 to communicate with the mixing chamber 221.

The body 41 is arranged so that the central portion of the body 41 constitutes a closure plug 45 for the bottle 46, and a flange 48 is also formed integrally. It will therefore be seen that the body 41 is formed with an annular groove 49 to receive the upper edge of the bottle 46. The bottle 46 has grooves 50 formed in the upper end thereof for mating with ridges 51 formed on the flange 48. Again, many other designs may be utilized to hold the body 41 in position on the bottle 46, but the fingers and grooves here shown will operate satisfactorily, and appropriate stops can be added as desired.

Looking at FIGS. 6 and 7 of the drawings, it will be seen that, in this embodiment, the mixing chamber 221 is formed on the outside edge of the body 41, and is located on the inside of the bottle 46. The orifice 224 is, then, formed in the upper edge of the bottle 46 which functions as the ring 38. While the flange 48 is here shown as extending down past the orifice 224, so the flange 48 is divided with a pair of secondary orifices 52 and 54, it will also be understood that the flange 48 could terminate above the orifice 224 to obviate the need for the orifices 52 and 54.

From the foregoing description, it should be understood that the operation of the sprayer shown in FIGS. 6, 7 and 8 is the same as the operation of the previously described embodiment. The bottle 46 will be squeezed, and air will be forced through the air passageway 222 and to the mixing chamber 221, through the orifice 224, then through the secondary orifice 52. Liquid will be forced through the dip tube 215, then through the passageway 44, and through the liquid feed tubes 216 and 218, thence into the mixing chamber 221.

FIG. 8 shows the device of this embodiment in the "off" position. It will be understood that the entire body 41 is rotated so the pasageways 222, 225, etc. are not aligned with the orifice 224 through the bottle 46. In FIG. 8, it will be seen that the orifice 224 is located approximately 90° from the other passageways so the sprayer is completely off. Obviously the body 41 can be rotated to align one of the passageways with the orifice 224, so the bottle will deliver a spray in the position shown in FIG. 6, or will deliver a steady stream of liquid if the passageway 225 is aligned with the orifice 224.

Thus, it will be seen that the sprayer shown in FIGS. 6, 7 and 8 of the drawings is provided with the body 41 as one piece and the dip tube 215 as the second piece. The upper end of the bottle 46 must cooperate with the two pieces to provide the complete sprayer as has been discussed. While only the orifice 224 is shown as formed in the bottle, it will be understood that the entire mixing chamber can be formed in the bottle, if desired, so the various passages would extend all the way to the edge of the body 41.

Further modifications of the sprayer of the present invention are shown in FIGS. 9 and 10 of the drawings. The primary feature of the device shown in FIGS. 9 and 10 is that FIG. 9 shows a three piece sprayer made in accordance with the present invention and FIG. 10 shows a two piece sprayer made in accordance with the present invention, but the devices of FIGS. 9 and 10 utilize precisely the same body member.

In more detail, and looking first at FIG. 9 of the drawings, it will be seen that the sprayer in FIG. 9 includes a body 60 having an annular groove 61 defined therein. The annular groove 61 receives an upstanding ring 62 which extends from a cap member 64. The cap member 64 has threads 65 for engaging threads on the bottle 66, and also includes a shoulder 68 for sealing against the top of the bottle 66.

The ring 62 is provided with an orifice 69; and, the body 60 defines a flange 70 which has a pair of secondary orifices 71 and 72.

Within the body 60, there is an air passageway 74 extending from a point to communicate with the inside of the bottle 66, and extending to a mixing chamber 75. The mixing chamber 75 is located inside the upstanding ring 62, and would be formed similarly to the mixing chamber shown in FIG. 5 of the drawings.

There is also a recess 76 for receiving the dip tube 78. The recess 76 has a passageway 79 which communicates with a liquid passageway 80. Though not here illustrated, it will be understood from the foregoing descriptions that liquid feed tubes would also communicate with the passageway 79 and communicate with the mixing chamber 75.

As a result, it should be understood that the device shown in FIG. 9 of the drawings is oriented so that, when the bottle 66 is squeezed, air will be forced through the air passageway 74 and liquid will be forced through the dip tube 78, through the liquid passageway 79, and through the liquid feed tubes to the mixing chamber 75. The orifice 69 is aligned with the mixing chamber 75 so that a spray would emerge from the spray bottle. The body 60 is rotatable so that the liquid passageway 80 can be brought into alignment with the orifice 69 and a liquid stream could be dispensed from the bottle in accordance with the previously discussed embodiments. Similarly, the body 60 could be rotated so that none of the passageways is aligned with the orifice 69, and the sprayer shown in FIG. 9 would be in an "off" position.

Looking now at FIG. 10 of the drawings, the body 60 is exactly the same, so all parts carry the same reference numerals, and no further description of the body 60 is thought to be required. In the device shown in FIG. 10, however, the cap member 64 is not utilized, and the upper end 81 of the bottle 82 is received within the annular groove 61 to perform the same role as the upstanding ring 62 on the cap member 64. Because of this, it will be understood that the bottle 82 is provided with an orifice 84. The operation of the embodiment shown in FIG. 10 will be precisely the same as the operation of the embodiment shown in FIG. 9, but one piece has been done away with, and the bottle itself is substituted therefor.

It will be readily understood that the mixing chamber 75 may be formed into the body 60 as shown, or it may be formed inside the ring 62 (FIG. 9) or the bottle portion 81 (FIG. 10). In either case, relative movement between the body and the ring will seal the appropriate passageways, and align the selected passageway with the orifice.

From the foregoing discussion, it should now be understood that the present invention provides an extremely simple sprayer for a squeeze bottle, the sprayer also utilizing a highly efficient method for mixing the liquid and air so that virtually any liquid can be sprayed using the sprayer of the present invention. With the method of establishing a stream of air from front to back, then feeding liquid under pressure sideways and somewhat tangentially into a mixing chamber, even difficult to atomize materials such as fats and oils can be broken up and delivered in a fine spray by the sprayer made in accordance with the present invention. Further, while a simple orifice has been illustrated, it will be obvious that a spout could be added, and various nozzles and the like could provide further control of the flow.

It will of course be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as defined in the appended claims.

I claim:

1. A sprayer, for use with a squeeze bottle wherein said bottle is squeezed to raise the liquid level and create air pressure within said bottle and to force liquid through a tube, said sprayer including a body closing said bottle, an air passage defined in said body, a dip tube extending from said body into the liquid, a liquid passageway defined in said body and communicating with said dip tube, a ring generally circumferentially of said body and movable relative to said body, a mixing chamber defined between said ring and said body so that said body provides the inner wall of said mixing chamber and said ring provides the outer wall of said mixing chamber, said air passage extending from within said bottle above the liquid level to said inner wall of said mixing chamber in a location generally centrally of said mixing chamber, at least one liquid feed tube in communication with said liquid passageway, a liquid passage connecting said liquid feed tube to a side of said mixing chamber, an orifice defined in said ring, said orifice being selectively movable to a position wherein said orifice is within said outer wall of said mixing chamber generally aligned with said air passage, the arrangement being such that air passes through said air passage, through said mixing chamber, then through said orifice, and liquid passes through said liquid feed tube, through said liquid passage, and into said mixing chamber to engage the side of the stream of air.

2. A sprayer as defined in claim 1, said body further defining a stream passageway communicating with said dip tube, said orifice being selectively alignable with said stream passageway, the arrangement being such that said ring acts as means for blocking said mixing chamber.

3. A sprayer as claimed in claim 1, and including means for fixing said body to said bottle comprising a skirt depending from said body, and fastening means on said skirt for engaging complementary fastening means on said bottle.

4. A sprayer as claimed in claim 1, said ring comprising the neck of said bottle, and means for fixing said body to said bottle comprising a flange overlying said ring, said ring defining at least one groove therein, said flange having at least one projection for cooperation with said at least one groove.

5. A sprayer as claimed in claim 1, and means for fixing said body to said bottle comprising a skirt depending from said ring, and fastening means on said skirt for engaging complementary fastening means on said bottle, said ring being rotatably fixed to said body.

6. A sprayer, for use with a squeeze bottle having a dip tube extending into liquid in said bottle, and air above said liquid within said bottle, said sprayer including a body closing said bottle and defining a mixing chamber therein, an air passage connecting the central portion of said mixing chamber with said air above said liquid, a liquid passageway connecting said dip tube to a peripheral wall of said mixing chamber, and movable means defining the outer wall of said mixing chamber, said movable means defining an orifice therethrough, said orifice being selectively alignable with said air passage for allowing said sprayer to spray, said movable means being selectively movable to displace said orifice and seal said mixing chamber.

7. A sprayer as claimed in claim 6, said body defining an additional liquid passageway in communication with said dip tube, said movable means being movable to align said orifice with said additional liquid passageway while sealing said mixing chamber so that only liquid will be discharged from said bottle.

* * * * *